United States Patent [19]

Schwartz et al.

[11] 4,112,900

[45] Sep. 12, 1978

[54] FUEL INJECTION SYSTEM

[75] Inventors: Reinhard Schwartz, Stuttgart; Heinrich Knapp, Leonberg; Klaus Riel, Möglingen; Klaus-Jürgen Peters, Affalterbach, all of Fed. Rep. of Germany

[73] Assignee: Robert Bosch GmbH, Stuttgart, Fed. Rep. of Germany

[21] Appl. No.: 836,184

[22] Filed: Sep. 23, 1977

Related U.S. Application Data

[63] Continuation-in-part of Ser. No. 683,401, May 5, 1976, abandoned.

[30] Foreign Application Priority Data

May 7, 1975 [DE] Fed. Rep. of Germany ..... 2520322

[51] Int. Cl.[2] ..... F02M 7/18

[52] U.S. Cl. ..... 123/139 AW

[58] Field of Search ..... 123/139 AW

[56] References Cited

U.S. PATENT DOCUMENTS

| | | | |
|---|---|---|---|
| 3,791,359 | 2/1974 | Eckert | 123/139 AW |
| 3,835,828 | 9/1974 | Knapp | 123/139 AW |
| 3,983,856 | 10/1976 | Stumpp | 123/139 AW |

*Primary Examiner*—Robert G. Nilson
*Attorney, Agent, or Firm*—Edwin E. Greigg

[57] ABSTRACT

A fuel injection system for externally ignited internal combustion engines in which a fuel metering and distributing valve is controlled by an air sensing element disposed in the air suction tube of the engine and by structure which is adapted to alter the restoring force exerted on the air sensing element through the fuel metering and distributing valve. The noted structure includes a control pressure conduit, a pressure control valve connected to the control pressure conduit, a second conduit for connecting the pressure control valve to the suction tube of the engine downstream of the butterfly valve, and a third conduit for connecting the pressure control valve to the atmosphere or to the air suction tube downstream from an air filter. With this structure it is possible to alter the restoring force mentioned above so that an enriched fuel-air mixture is achieved when the butterfly valve is opened to its full load position, and so that a leaner fuel-air mixture is achieved when the butterfly valve is closed to a partial load position.

5 Claims, 1 Drawing Figure

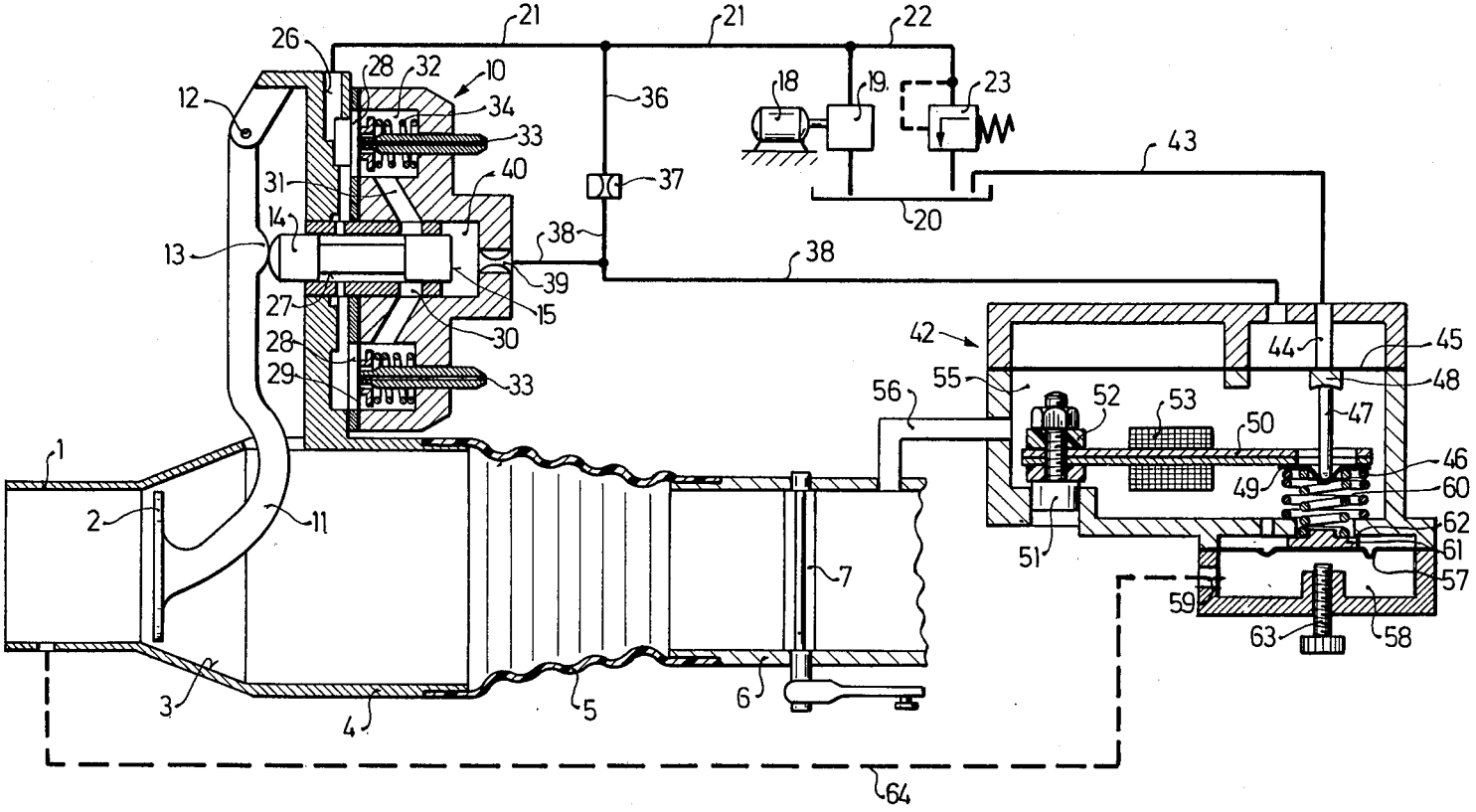
1
2
3
4
5
6
7
10
11
12
13
14
15
18
19
20
21
22
23
26
27
28
29
30
31
32
33
34
36
37
38
39
40
42
43
44
45
46
47
48
49
50
51
52
53
55
56
57
58
59
60
61
62
63
64

FUEL INJECTION SYSTEM

CROSS-REFERENCE TO RELATED APPLICATION

This application is a continuation-in-part of our copending application, Ser. No. 683,401, filed on May 5, 1976, now abandoned.

BACKGROUND OF THE INVENTION

The present invention relates to a fuel injection system for an externally ignited internal combustion engine.

The system according to the present invention operates on fuel which continuously injected into the suction tube of the engine in which a sensing element and an arbitrarily operable throttle valve (butterfly valve) are disposed in series. The sensing element is displaced by and in proportion to the quantity of air flowing through the suction tube against a restoring force. In the course of its excursion, the sensing element displaces a movable component of a valve which is disposed in the fuel supply line and which is intended for metering a quantity of fuel which is proportionate to the quantity of air. The aforenoted restoring force is supplied by liquid under pressure which is delivered continuously under constant, but arbitrarily variable pressure through a control pressure line. The pressurized liquid exerts a force on a control plunger. The pressure of the pressurized liquid is variable by at least one pressure control valve controllable as a function of the engine parameters. The pressure control valve preferably takes the form of a flat seat valve comprising a valve membrane (diaphragm) as the movable valve part.

Fuel injection systems of this type are designed to automatically provide a good fuel-air mixture for all operational conditions of the internal combustion engine so as to burn the fuel as completely as possible and thus prevent toxic exhaust gases from being produced, or at least to considerably reduce the same, while obtaining maximum performance of the internal combustion engine, with minimum fuel consumption. The quantity of fuel must therefore be very accurately metered in accordance with the requirements of each operational state of the internal combustion engine.

In the case of known fuel injection systems of this type, the quantity of fuel which is metered is, as far as possible, proportionate to the quantity of air flowing through the suction tube. The ratio of the quantity of fuel which is metered to the quantity of air may be varied by changing the restoring force of the sensing element as a function of the operating parameters by means of the pressure control valve.

It has been found that it is advantageous to enrich the fuel-air mixture during full load operation as compared to the fuel-air mixture during partial load operation.

OBJECT AND SUMMARY OF THE INVENTION

The principal object of the present invention is to provide a fuel injection system of the known type, by means of which the fuel-air mixture can be enriched at or near full load by simple means.

This object and others are accomplished according to the present invention in that for the purpose of enriching the fuel-air mixture during full load, a pressure control valve is provided which comprises two pressure chambers separated by a control membrane. The first of these pressure chambers is in communication with the suction tube of the engine downstream of a throttle valve which is mounted within the suction tube, via a pressure conduit, and the second pressure chamber is in communication with a reference pressure. A valve spring acting on the valve membrane is disposed in the first chamber, and a control spring is disposed between the valve membrane and the control membrane.

According to an advantageous feature of the present invention, the reference pressure in the second pressure chamber is constituted by atmospheric pressure or the pressure in the suction tube section downstream of an air filter.

Another advantageous feature of the present invention results from the arrangement in which the movement of the control membrane is adapted to be limited by stops.

Still another advantageous feature of the present invention results from the arrangement in which at temperatures below the operating temperature of the engine, the closing force exerted on the valve membrane may be reduced by an electrically heatable bimetallic spring.

A preferred embodiment of the present invention is represented in the drawing and will be described in detail hereinafter.

BRIEF DESCRIPTION OF THE DRAWING

The sole FIGURE illustrates a fuel injection system according to a preferred embodiment of the present invention including the structure for varying the fuel-air ratio of the fuel mixture delivered to the engine during engine load changes

DESCRIPTION OF THE PREFERRED EMBODIMENT

In the fuel injection system illustrated, the combustion air first flows through an air filter (not represented), and then flows in the direction of the arrow through a suction tube portion 1, past a sensing element or air sensor 2, which is disposed in a conical portion 3. From the conical portion 3 the air flows in a suction tube portion 4, and thereafter through a coupling hose 5 into a suction tube portion 6, in which there is disposed an arbitrarily operable throttle valve (butterfly valve) 7. From the latter, the combustion air flows to one or more cylinders (not shown) of an internal combustion engine. The air sensor 2 consists of a plate, disposed at right angles to the direction of air flow, which is displaced in the conical suction tube portion 3 as an approximately linear function of the air flowing through the suction tube. Given a constant restoring force exerted on the air sensor 2 as well as a constant pressure prevailing upstream of the air sensor 2, the pressure prevailing between the air sensor 2 and the throttle valve 7 also remains constant.

The air sensor 2 directly controls a fuel metering and distributing valve 10. For the transmission of the motion of the air sensor 2, there is provided a lever 11, which is connected to the air sensor 2 at one end, and pivotably mounted on a pivot point 12 at the other end. The lever 11 is provided with a nose 13, and during the pivoting movement of the lever 11, the nose 13 actuates a movable slide member 14, which constitutes a control plunger of the fuel metering and distributing valve 10. A front face 15 of the control plunger 14, which is disposed remote from the nose 13, is exposed to the force of pressurized liquid. The pressure of this liquid acting on the face 15, produces the restoring force acting on the air sensor 2.

Fuel is supplied by means of a fuel pump 19, which is driven by an electric motor 18, and which draws fuel from a fuel tank 20, and delivers it through a conduit 21 to the fuel metering and distributing valve 10. From the conduit 21, there extends a conduit 22 in which is disposed a pressure limiting valve 23. When there is excessive pressure in the system, the pressure limiting valve 23 allows fuel to flow back into the fuel tank 20.

From the conduit 21, the fuel is admitted into a channel 26 provided in the housing of the fuel metering and distributing valve 10. The channel 26 leads to an annular groove 27 of the control plunger 14, and further leads through several branch conduits to chambers 28, which are disposed on one side of a membrane 29, so that this side of the membrane 29 is exposed to fuel pressure. Dependent upon the axial position of the control plunger 14, the annular groove 27 overlaps and, as a result, opens to a greater or lesser extent control slots 30, which lead through channels 31, to chambers 32. Each of the chambers 32 is separated from a corresponding chamber 28 by means of the membrane 29. From the chambers 32 the fuel is admitted through injection channels 33 to individual fuel injection valves (not shown) which are positioned in the suction tube in the vicinity of a corresponding engine cylinder. The membrane 29 serves as the movable part of a flat seat valve which is maintained open by means of a spring 34 when the fuel injection system is inoperative. The membrane boxes, each formed of a chamber 28 and 32, ensure that the pressure drop at the fuel metering valves 27, 30 remains substantially constant, independent of the overlap between the annular groove 27, and the control slots 30, that is, independent of the quantity of fuel flowing to the fuel injection valves. In this way, it is ensured that the extent of displacement of the control plunger 14 is proportionate to the metered fuel quantity.

Upon a pivotal movement of the lever 11, the air sensor 2 is moved in the conical portion 3 of the suction tube and, as a result, the annular flow passage section between the air sensor 2 and the conical portion 3, changes in proportion to the extent of the displacement of the air sensor 2.

The liquid producing the constant restoring force on the control plunger 14, is fuel. For this purpose, from the conduit 21, there extends a conduit 36, which is separated from a pressure control conduit 38 by means of an uncoupling throttle 37. A pressure chamber 40 communicates with the pressure control conduit 38 via a damping throttle 39. The front face 15 of the control plunger 14 projects into the pressure chamber 40.

A pressure control valve 42 is disposed in the control pressure conduit 38. The pressurized fluid can pass to the fuel tank 20 through a depressurized return conduit 43 via the pressure control valve 42. The pressure of the pressurized liquid producing the restoring force can be varied in a temperature-dependent manner and in dependence on the pressure in the suction tube downstream of the throttle valve 7, by means of the pressure control valve 42. The pressure control valve 42 is in the form of a flat seat valve, having a stationary valve seat 44, and a valve membrane 45, which is biased in the closing direction of the valve, inter alia, by a spring 46. The valve spring 46 exerts pressure on the valve membrane 45 via a pin 47, which is disposed between a spring rest 49 and a bearing seat 48, connected to the valve membrane 45. At temperatures below the engine operating temperature, the closing force transmitted to the pressure control valve 42 by the valve pin 47 works against one end of a bi-metallic spring 50 which, during the warm-up stage, rests against the spring rest 49. The other end of the bi-metallic spring 50 is secured by means of a bolt 51 pressed into the housing of the pressure control valve 42. The bi-metallic spring 50 is largely protected against losing heat to the housing of the pressure control valve 42 by means of an insulating element 52 disposed between the bolt 51, and the bi-metallic spring 50. An electric heater 53 is placed on the bi-metallic spring 50.

A first pressure chamber 55 of the pressure control valve 42 is in communication, via a pressure line 56, with the suction tube pressure of the suction tube portion 6 downstream of the throttle valve 7, and is separated from a second pressure chamber 58 by a control membrane 57.

The second pressure chamber 58 is in communication with the atmosphere via an opening 59. A control spring 60 is arranged parallel to the valve spring 46 in the first pressure chamber 55. The control spring 60 is supported on its one side by the spring rest 49, and on the opposite side by another spring rest 61, which is disposed on the control membrane 57. The movement of the control membrane 57 can be limited, on one side, by the spring rest 61 coming into contact with a first stop 62, and, on the other side, by the control membrane 57 coming into contact with a second stop 63, which, in the embodiment illustrated, consists of an arbitrarily adjustable screw.

Instead of being in communication with the atmosphere, the second pressure chamber can be connected to the suction tube portion 1, upstream of the air sensor 2 and, downstream of an air filter (not represented) via a line 64, which is represented in the drawing by a dashed line. As a result, the pressure drop at the air filter is not included and it is possible to operate with a lesser pressure difference at the control membrane 57, thereby preventing breakdowns resulting from clogging of the air filter.

The fuel injection system operates in the following manner:

When the internal combustion engine is running, fuel is drawn from the tank 20 by the pump 19 driven by the electric motor 18, and forced through the conduit 21 to the fuel metering and distributing valve 10. At the same time, the internal combustion engine draws air through the suction tube 1, and, as a result, the air sensor 2 undergoes a certain excursion from its rest position. In response to the deflection of the air sensor 2, the control plunger 14 is displaced by the lever 11, and thus the flow passage section at the control slot 30 is increased. The direct connection between the air sensor 2 and the control plunger ensures a constant ratio between the quantity of air and the metered quantity of fuel provided the characteristics of these two components are sufficiently linear (which is desideratum by itself). In such a case, the fuel-air ratio would be constant for the entire operational range of the engine. However, it is necessary for the fuel-air mixture to be richer or leaner depending on the operational conditions and this is achieved by varying the restoring force acting on the air sensor 2. For this purpose, there is provided in the control pressure conduit 38, the pressure control valve 42, which, by influencing the pressure of the pressurized liquid, during the warm-up stage of the internal combustion engine, influences the fuel-air ratio as a function of the temperature until the operating temperature of the internal combustion engine is reached or during full load. The control pressure is determined by the closing force transmitted to the valve membrane 45 by the valve pin 47. However, at temperatures below the operating temperature of the internal combustion engine, the bi-metallic valve spring 50 acts on the spring rest 49 against the force of the valve spring 46 and the control spring 60, thereby reducing the closing force exerted on the membrane 45. However, immediately after the engine is started, the bi-metallic valve spring 50 is heated by means of the electric heater 53, which results in a reduction in the force exerted by the bi-metallic spring 50 against the spring rest 49. The requisite initial biasing of the spring 50 can be achieved by pressing the bolt 51 to a varying depth in the housing of the pressure control valve 42.

When the internal combustion engine is operated at full load, according to the invention, the pressure of the pressure fluid in the control pressure line is reduced, to obtain extra fuel in addition to the quantity of fuel metered at the fuel metering and distributing valve 10 in proportion to the quantity of air drawn in, for the purpose of obtaining a richer fuel-air mixture. As a result of the reduction in the pressure of the pressurized liquid in the control pressure conduit 38, the restoring force exerted on the air sensor 2 is reduced and, as a result, the displacement of the air sensor 2 and thus of the control plunger 14 is more extensive, whereupon an increased quantity of fuel is metered at the metering valve 27, 30.

The reduction in the pressure of the pressurized liquid in the control pressure conduit 38 occurs as a result of the fact that when the throttle valve 7 is in the full load position, the suction pressure in the suction tube section 6 downstream of the throttle valve 7 increases, thereby producing a pressure difference at the control membrane 57, i.e., the pressure existing on both sides of the membrane 57 reach a state of equilibrium due to opening 64, resulting in a force unbalance towards the stop 63 due to the force of spring 60. This pressure difference (force unbalance) results in a reduction of the force of the control spring 60 on the valve pin 47, and thus of the closing force exerted on the membrane 45. This occurs in addition because the pressure surface of the control membrane 57 is larger than the pressure surface of the valve membrane 45 as shown. During full load, the control membrane 57 is in contact with the second stop 63.

If there is a reduction in the suction tube pressure downstream of the throttle valve 7 when the throttle valve is in a partial load position, there is produced at the control membrane 57, a pressure difference which leads to an increase in the closing force exerted on the membrane 45, whereupon the control pressure in the control pressure conduit 38 increases and a reduced quantity of fuel is metered at the metering valves 27, 30. As a result, a leaner fuel-air mixture is obtained in the partial load position than in the full load position.

What is claimed is:

1. A fuel injection system for externally ignited internal combustion engines comprising, in combination:

(a) a suction tube for air intake to the engine;
(b) an air sensor disposed in said suction tube;
(c) an arbitrarily operable butterfly valve disposed in said suction tube in series with said air sensor;
(d) a fuel supply conduit;
(e) a control pressure conduit;
(f) a fuel metering valve connected to said fuel supply conduit and said control pressure conduit for continuously injecting fuel into said suction tube;
(g) a control plunger, serving as the movable member of said fuel metering valve, said control plunger being acted upon on one end by said air sensor, and on an opposite end by a return force provided by liquid under constant but arbitrarily variable pressure delivered by said control pressure conduit, for metering a fuel quantity that is proportionate to the quantity of air measured by said air sensor; and
(h) at least one pressure control valve in the form of a flat seat valve having a membrane as the movable valve part, said pressure control valve being disposed in said control pressure conduit for varying pressure in said control pressure conduit in dependence on at least one operating parameter of the engine and thereby varying the fuel-air ratio at or near full load operations wherein said pressure control valve includes:
(i) a valve membrane;
(ii) a control membrane;
(iii) two pressure chambers separated from one another by said control membrane;
(iv) a pressure conduit connected to a first one of the pressure chambers and to the suction tube downstream of the butterfly valve;
(v) means for communicating a reference pressure to a second one of the pressure chambers;
(vi) a valve spring disposed in the first one of the pressure chambers, said valve spring acting against the valve membrane; and
(vii) a control spring disposed between the valve membrane and the control membrane.

2. The fuel injection system as described in claim 1, wherein atmospheric pressure serves as the reference pressure in the second pressure chamber.

3. The fuel injection system as described in claim 1, wherein the pressure in the suction tube section upstream of the air sensor serves as the reference pressure in the second pressure chamber.

4. The fuel injection system as described in claim 1, wherein the pressure control valve further comprises stops for limiting the movement of the control membrane.

5. The fuel injection system as described in claim 1, wherein the pressure control valve further comprises an electrically heatable bi-metallic spring for reducing the closing force exerted on the valve membrane at temperatures below the operating temperature of the engine.

* * * * *